US007662054B2

(12) United States Patent
Erickson

(10) Patent No.: US 7,662,054 B2
(45) Date of Patent: Feb. 16, 2010

(54) HOCKEY SHOOTING AND RETURN SYSTEM TRAINING DEVISE

(76) Inventor: John Scott Erickson, 1800 Keller Lake Dr., Burnsville, MN (US) 55306

( * ) Notice: Subject to any disclaimer, the term of this patent is extended or adjusted under 35 U.S.C. 154(b) by 16 days.

(21) Appl. No.: 11/778,059

(22) Filed: Jul. 15, 2007

(65) Prior Publication Data

US 2008/0015060 A1 Jan. 17, 2008

Related U.S. Application Data

(60) Provisional application No. 60/807,504, filed on Jul. 17, 2006.

(51) Int. Cl.
*A63B 69/00* (2006.01)

(52) U.S. Cl. ..... 473/446; 473/422

(58) Field of Classification Search ..... 473/446, 473/415, 422, 478, 459, 435; 273/118 R; 463/30

See application file for complete search history.

(56) References Cited

U.S. PATENT DOCUMENTS 4,407,501 A * 10/1983 Bates ..... 273/118 R
4,607,842 A * 8/1986 Daoust ..... 473/446
5,484,147 A * 1/1996 Fagan ..... 473/446
6,059,673 A * 5/2000 Mason ..... 473/478
6,514,162 B1 * 2/2003 Karellas ..... 473/446
6,846,252 B2 * 1/2005 Nudo ..... 473/446
6,945,881 B2 * 9/2005 Bates ..... 473/415
6,966,853 B1 * 11/2005 Wilkerson et al. ..... 473/446
7,104,901 B1 * 9/2006 Mason ..... 473/446
2007/0270214 A1 * 11/2007 Bentley ..... 463/30
2008/0254918 A1 * 10/2008 Wagner ..... 473/459

* cited by examiner

*Primary Examiner*—Mitra Aryanpour

(57) ABSTRACT

Hockey Shooting and Return System Training Devise used by hockey players which provides a very time and space efficient method for practicing ones shot. It is efficient for it returns the shot hockey puck back to the shooter relying only on the speed of the puck and the geometry of the return chute to accomplish this. In addition, the devise records and displays the current shot speed, and stores data of shots, so additional statistical data can be later viewed. The devise can be used for on ice training, and also for off ice training.

5 Claims, 2 Drawing Sheets

HOCKEY SHOOTING AND RETURN SYSTEM TRAINING DEVISE

FIELD OF THE INVENTION

This invention relates generally to the field of sports training devises, and, more particularly, to hockey shooting and return system training devises.

BACKGROUND OF THE INVENTION

Practicing ones shot for hockey has always been a challenge. It usually involves shooting on ice in a hockey rink at the goal cage, and having to retrieve pucks after being shot. Off ice, players shoot at walls but still need to retrieve the shot pucks.

U.S. Pat. No. 6,966,853 to Jeremy Wilkerson and Richard Wilkerson discloses a hockey shooting training devise having a motorized conveyor system in a fenced area to return shot pucks. Wilkerson is limited in that a fenced area is required with a conveyor system to retrieve the shot pucks.

It is an object of the present invention to provide a hockey shooting and return system which relies solely on energy of the shot puck combined with the geometry of the return chute to have the shot puck returned to the shooter, reducing or wholly overcoming some or all of the difficulties inherent in prior known devices.

SUMMARY

The principles of the invention is to provide a very time and space efficient hockey shooting training devise to return the shot hockey puck back to the shooter. In addition to this, the devise records and displays the current shot speed, and stores data of shots, so the statistical data can be later viewed. The devise can be used for on ice training, and also for off ice training.

Main components of invention consist of a lead in shooting surface, where shot puck is delivered from by the shooter. A raised platform approximately the height of hockey skate blades borders the lead in shooting surface. Shot puck is received from the lead in shooting surface by the return chute. Shooter is typically positioned five to ten feet from the return chute, but can be as close as three feet or more than ten feet, pending on training objective and room availability. The return chute includes an elliptical surface which receives the shot puck from the shooter and returns it back to the shooter. Centrifugal force of the moving puck keeps the shot puck in contact with the elliptical surface as it travels along its surface, changing direction approximately by 180° along its length. The elliptical surface is supported at its edges by the chute sides. Chute edges exposed to the entering pucks into the chute can be protected by chute edge protective wings made from material suitable to withstand impact of a hockey puck traveling up to 120 MPH. Return chute also contain a sensing, counting, timing, recording, and display system. This sensing, counting, timing, recording, and display system is to provide instantaneous feed back to shooter on last shot and also to store, track, and compare progress of development over periods of time. To protect area in back of the return chute, extended return chute wings are used to stop pucks which are shot wide of the return chute.

Following defines the aforementioned components in more detail and references to applicable drawings and figures. This detail will include the manner and process of making and using this devise.

DETAILED DESCRIPTION OF THE INVENTION

Figure 1:
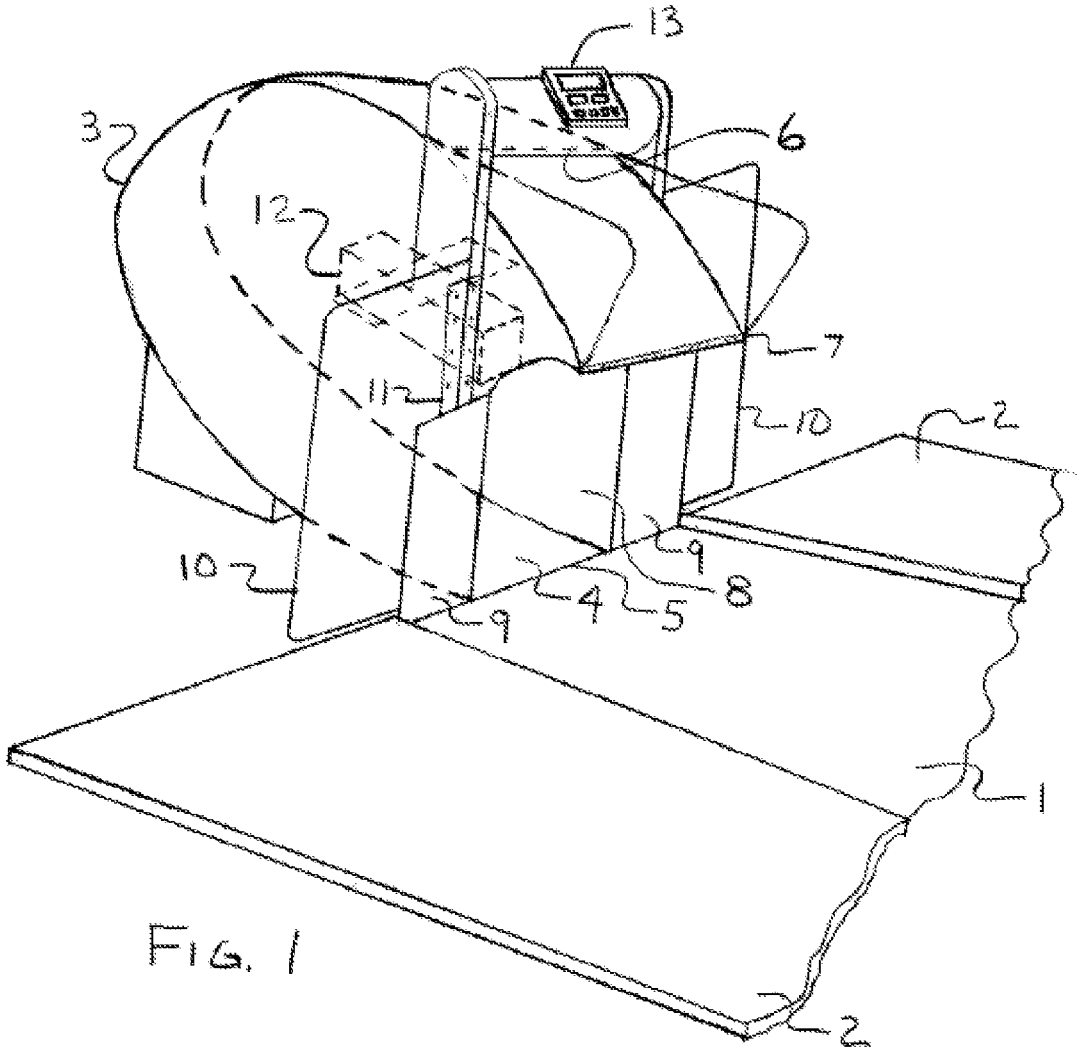
FIG. 1 shows the shooting training devise system as a whole.

Lead in shooting surface 1 shown in FIG. 1 is typically but not limited to be made from High Density Polyethylene sheets. It can be made of any readily available durable plastic, vinyl or other material which has a smooth surface. In some cases, the existing surface the return chute is placed on can be used without adding an additional surface. This is especially true if positioned on an ice surface, or even smooth bare concrete, wood, or tile to name a few acceptable surfaces.

A raised platform 2 borders all edges of the lead in shooting surface except edge common to the return chute. This raised platform serves two purposes. First—it represents the height of a typical ice hockey skate blade. Secondly—it helps contained the returned pucks to expedite training session. The raised platform can be made out of wood or molded plastics. Its surface should be a non slip surface to provide good traction for the shooter. This raised platform would not be used when the user of this system is wearing hockey skates, either roller or ice. At the shooter discretion, these raised platforms could not be used even if shooter does not have skates on.

The return chute 3 consist of the following components: elliptical surface 4, chute sides 5, chute edge protective wings 9, sensing, counting, timing, recording, and display system 13, and extended return chute wings 10.

Elliptical surface 4 provides the main surface shot puck will glide along while returning puck to the shooter and the horizontal confinement. Its leading edge 5 is common to the exiting edge of the lead in shooting surface 1. It redirects the puck approximately 180° along its length. It can be hinged 6 (mechanical or plastic) at the exit end to allow directional control of the returned puck. When hinged a more downward directional path keeps puck closer to the surface of the lead in shooting surface as it exits the return chute. This provides a more controllable returned shot for the novice. A more upward directional path causes puck to return high (3" to 12" off the shooting surface) to the shooter as it exits the return chute. This forces the shooter to have to knock the puck out of the air as it is returned. This is good for the advanced player, allowing them to work on their eye to hand coordination; knocking pucks out of the air as the puck approaches the shooter after it exits the return chute 3.

The elliptical surface 4 can be made of numerous formable durable materials. One such material is High Density Polystyrene plastic. It can be made from HDPE sheets, or made by using a thermoplastic mold process which the final product would incorporate all the features of the return chute, in a single or multiple section assembly. The molded version can be a single or multi-wall design.

A sound deadening layer 7 can be incorporated to the elliptical surface 4. This can be done by adding a dense pliable material to the outer surface such as a rubber. Or an expandable material can be injected into the multi-wall thermoplastic molded version.

The chute sides 8 provide the vertical support to the elliptical surface 4 and the vertical confinement of the shot puck. They can be made from but not limited to typical sheets of particle board, plywood, High Density Polyethylene or other suitable plastic. They also can be made from moldable High Density Polyethylene or other suitable plastic. The chute sides 8 sides are parallel at the entrance point of the return chute 3. They can continue to be parallel past this point when constructed from sheet material. If made in a thermoplastic moldable manner, the side can contour inward in a manner not to impede a consistent flow of the puck, to minimize material and space requirements.

The entrance edges of the return chute 3 are subject to abuse from inaccurate shot pucks which hit its edges and not the center of the return chute 3 as intended. This causes a need for these edges to be protected by chute edge protective wings 9. The chute edge protective wings 9 are approximately perpendicular to the chute sides 8. The chute edge protective wings 9 can be made from, but limited to, a durable material such as rubber based material. Sheets of the rubber material can be used to make the chute edge protective wings 9 and be mechanically fastened to the entrance edges of the return chute 3. The also can be molded into the chute sides 8 if the chute sides 8 are molded.

Because the chute edge protective wings 9 are relatively flexible, they may need additional support. Also, the chute edge protective wings 9 are small in nature and additional surface area is needed for the unskilled user to protect the area behind the return chute 3 from inaccurately shot pucks. Due to the two previously sited statements, extended chute edge protective wings 10 may be incorporated into the return chute 3.

They can be made from but not limited to typical sheets of particle board, plywood, or High Density Polyethylene or other suitable plastic. They also can be made from moldable High Density Polyethylene or other suitable plastic. The extended chute edge protective wings 10 are hinged 11 to return chute sides allowing them to be extended during shooting use, and retracted for storage and transit. The hinge configuration provides "give" to the extended chute edge protective wings 10 to help absorb the impact from the shot puck. They are located directly behind the chute edge protective wings 9 to provide the chute edge protective wings 9 additional support. The extended chute edge protective wings hinge 11 can be but not limited to be set at a slight angle from true vertical to allow natural tendency to be biased forward to the open position. The extended chute edge protective wings 10 in turn have detent features in them to help hold them in the retracted position when not required to be extended.

The sensing, counting, timing, and recording system, along with the monitor 13 provides a means for continuous feedback of the shooter's performance to the shooter and stores the data for future reference. Feedback includes but is not limited to time, shot speed, shots per minute, total time extended during training session, accumulated velocity, accumulated velocity per time (Total Velocity), maximum velocity, minimum velocity, average velocity, standard deviation of shot speed, sessions total shots, and grand total of shots for all sessions. A microprocessor is used to store, process, and display the data in useable and meaningful means. A typical monitor 13 would show but not be limited to, current speed, number of shots, and elapsed time and contain numerous touchpads.

There are many ways to provide the means to measure the previously listed feedback. The main element required is to be able to capture the speed of the shot puck. This is done by identifying when puck has passed two points separated by a defined distance and measuring the time required for the puck to pass between these two points. Identifying when the puck has passed a point and sending a signal to a controller can be done through, but not limited to a mechanical switch, infra red switch, magnetic reed switch, continuous wave Doppler Radar circuit or a light gate sensor. The light gate method and components will be explained below.

Figure 2:
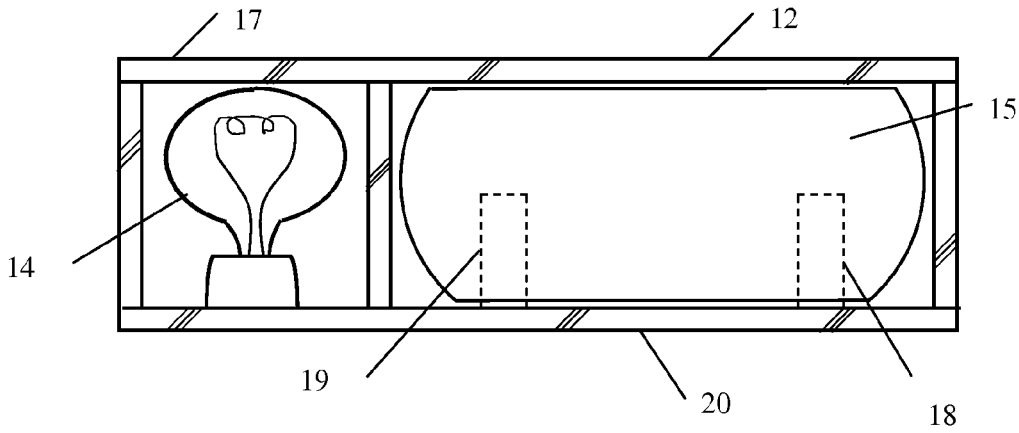
FIG. 2 shows a side view of the sensing, counting, timing, and recording system in the electronic container with side panel removed.

The light gate method requires two main components as shown in FIG. 2: a light source 14 and a sensing, counting, timing and recording electronic system which typically is called a chronograph 15 to those skilled in the art. These components, both of which are readily available to those skilled in the art, are housed in a rugged electronic container 12 which protect the components from miss directed shot pucks. The electronic container 12 is support by a structural member spanning between the two chute sides 8. This structural member can be made from but not limited to typical sheets of particle board, plywood, High Density Polyethylene or other suitable plastic. It also can be made from moldable High Density Polyethylene or other suitable plastic. The light source 14 is directed upwards through a circular opening 17 in the top of the electronic container 12 directly above the light source 14. This floods the interior of the return chute 3 with the appropriate amount of light for the proper functioning of the chronograph 15 and allows for heat disipitate from the light source. The chronograph 15 is positioned in the electronic container 12 with the front light gate sensor 18 and rear light gate sensor 19 pointing down. The bottom panel of the electronic container 12 common to the chronograph 15 is made of tempered glass or clear acrylic to allow light through to the sensors. The face of these two sensors is positioned so the sensors are parallel with the elliptical surface 4 directly below them and perpendicular with the chute sides 8. As the puck passes underneath the front light gate sensor 18, the front light gate sensor 18 detects the puck and starts a timer until puck is detected by the rear light gate sensor 19 and the timer is stopped. This time is recorded by the electronics in the chronograph 15. The speed is calculated by dividing the distance traveled (distance between the two light gate sensors) by the time it takes to travel this distance. The other listed feedback is data and form of data readily available and apparent to those skilled in this art, when incorporating the use of a microprocessor. The power source for both the light and the chronograph can be from but not limited to a standard 110 AC house hold power. This power will have to be converted to appropriate dc power for the chronograph 15. Timers are included in line with the power (or incorporated into the electronics of the chronograph), to the light and the chronographs so they will shut off at defined time set by user. This helps extending the life of both, especially the light, in case user forgets to shut the power off to them.

The accumulated velocity is a unique feedback which is most helpful to track one's development. It is the sum of individual velocities. When this value is summed up over a defined time (defined as Total Velocity), ((Speed of shot 1+Speed of shot 2+ Speed of shot 3 . . . )/time) is a very useful value to compare for not just the velocity of the shooters shot is defined, but the speed of how many shots are completed over a period of time. This provides a true reading for the rate a shooter can deliver a shot weighted with the speed of the shot. A quickly delivered shot is most helpful skill in the game of hockey, not only for shooting to score, but also for passing to a fellow team mate.

Figure 3:
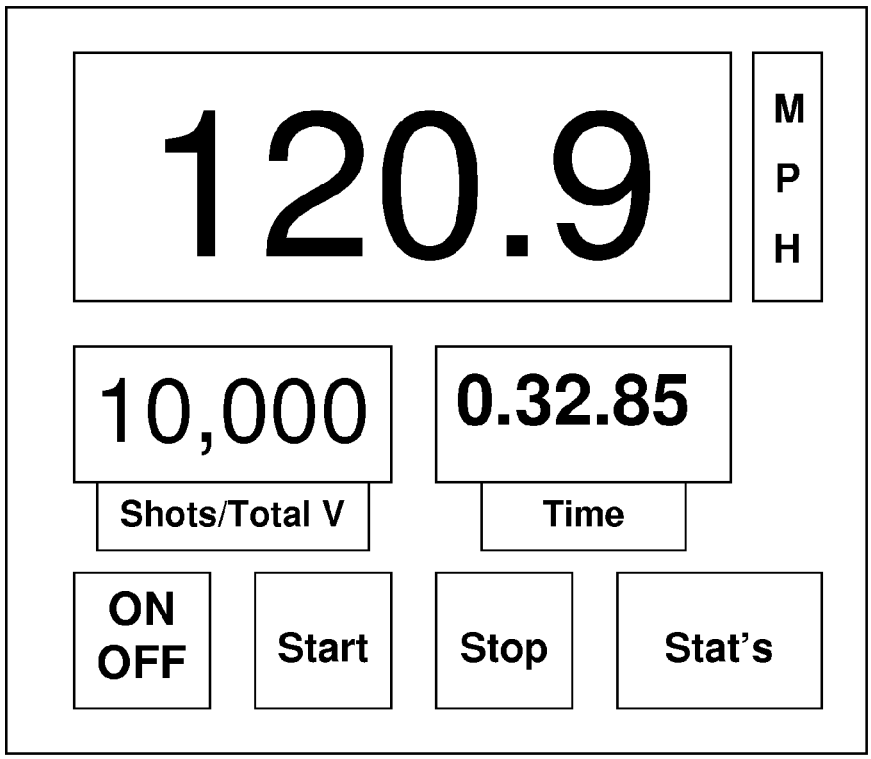
FIG. 3 shows the monitor.

A typical layout for the monitor is shown in FIG. 3. It consists of numerous touch pads. It should be understood this is one of many possible configurations of the touch pads and their arrangement.

The above has defined the invention in a preferred embodiment, it should be understood that this is only an example and not as a limitation to the scope of this invention.

What is claimed is:

1. A hockey shooting surface and return system training device for returning pucks shot by a shooter, comprising:

a shooting surface;

a raised platform positioned on either side of said shooting surface;

a return chute positioned on said shooting surface, said return chute comprising an elliptical surface, said elliptical surface having first and second chute edges, said elliptical surface supported at said first and second chute edges by said return chute;

said return chute further comprising a first chute side and a second chute side;

said return chute further comprising a first chute edge protective wing and a second chute edge protective wing for protecting entrance edges of said return chute;

means for sensing said shut puck; and means for providing continuous feedback of said shooter's performance;

wherein said elliptical surface is adjustable at an exit end of said return chute; and wherein said raised platform contains returned shot pucks in order to expedite training sessions.

2. A hockey shooting surface and return system training device for returning pucks shot by a shooter, according to claim 1, wherein, said means for sensing determines linear velocity of said shot puck, said means for sensing further including display means.

3. A hockey shooting surface and return system training device for returning pucks shot by a shooter, according to claim 1, wherein, said means for sensing further including means for counting, means for timing and means for recording.

4. A hockey shooting surface and return system training device for returning pucks shot by a shooter, according to claim 1, wherein, said return chute can be used by one or more shooters.

5. A hockey shooting surface and return system training device for returning pucks shot by a shooter, according to claim 1, wherein, said return chute returns said shot puck to an approximate origination point of said shot puck.

* * * * *